US011279165B2

(12) United States Patent
Skinner et al.

(10) Patent No.: US 11,279,165 B2
(45) Date of Patent: Mar. 22, 2022

(54) INK-BASED MARKING DEVICE HAVING A MULTI-COMPONENT NIB STRUCTURE

(71) Applicant: CRAYOLA LLC, Easton, PA (US)

(72) Inventors: Craig Skinner, Easton, PA (US); Robert N. Amabile, Bangor, PA (US); Scott Collins, Nazareth, PA (US); Jake Towne, Nazareth, PA (US)

(73) Assignee: Crayola LLC, Easton, PA (US)

( * ) Notice: Subject to any disclaimer, the term of this patent is extended or adjusted under 35 U.S.C. 154(b) by 0 days.

(21) Appl. No.: 17/003,520

(22) Filed: Aug. 26, 2020

(65) Prior Publication Data

US 2020/0391538 A1 Dec. 17, 2020

Related U.S. Application Data

(62) Division of application No. 16/386,757, filed on Apr. 17, 2019.

(Continued)

(51) Int. Cl.

| | |
|---|---|
| ***B43K 1/12*** | (2006.01) |
| ***B43K 1/01*** | (2006.01) |
| ***B43K 1/00*** | (2006.01) |

(52) U.S. Cl.

CPC ..... *B43K 1/12* (2013.01); *B43K 1/006* (2013.01); *B43K 1/01* (2013.01)

(58) Field of Classification Search

CPC . B43K 1/006; B43K 1/12; B43K 8/00; B43K 8/003; B43K 8/006; B43K 8/02; B43K 8/022; B43K 8/024; B43K 8/026; B43K 8/028; B43K 8/03; B43K 8/04; B43K 8/06; B43K 8/08; B43K 8/10; B43K 8/12;

(Continued)

(56) References Cited

U.S. PATENT DOCUMENTS 2,948,008 A * 8/1960 Leeds ..... A45D 34/04 401/263
4,568,214 A * 2/1986 Abe ..... A45D 34/042 401/141

(Continued)

FOREIGN PATENT DOCUMENTS

EP 2889153 A1 * 7/2015 ..... B43K 8/022
EP 3760452 A1 * 1/2021 ..... B43K 8/08

OTHER PUBLICATIONS

Non-Final Office Action dated Sep. 2, 2020 in U.S. Appl. No. 16/386,757, 9 pages.

(Continued)

*Primary Examiner* — David P Angwin
*Assistant Examiner* — Bradley S Oliver
(74) *Attorney, Agent, or Firm* — Shook, Hardy and Bacon LLP

(57) ABSTRACT

Embodiments of the invention are directed to a multi-component nib structure and marking device for selectively generating primary marks and a secondary marks for lettering and shading. The marking device includes a multi-component nib structure, an ink source. The multi-component nib structure generally includes a first nib component, a second nib component, and optionally, a transfer component between the first nib component and the second nib component. In other aspects, the multi-component nib structure may allow lettering with different tones creating, for example, an ombre effect.

16 Claims, 7 Drawing Sheets

Related U.S. Application Data

(60) Provisional application No. 62/658,699, filed on Apr. 17, 2018.

(58) Field of Classification Search
CPC ..... B43K 8/14; B43K 8/143; B43K 8/146; B43K 8/16; B43K 8/165; B43K 8/18; B43K 8/20; B43K 8/22; B43K 8/24
USPC ..... 401/196, 198, 199, 283
See application file for complete search history.

(56) References Cited

U.S. PATENT DOCUMENTS

| | | | | |
|---|---|---|---|---|
| 5,388,924 | A | 2/1995 | Chao | |
| 5,971,643 | A | 10/1999 | Ahmed | |
| 6,883,995 | B1 * | 4/2005 | Gueret | A45D 34/04 401/183 |
| 7,888,275 | B2 * | 2/2011 | Ward | D04H 1/00 442/353 |
| 8,858,109 | B2 | 10/2014 | Kudo | |
| 10,195,635 | B2 * | 2/2019 | Sporrer | A45D 19/00 |
| 2006/0163152 | A1 | 7/2006 | Ward et al. | |
| 2009/0257811 | A1 | 10/2009 | Brachman | |

OTHER PUBLICATIONS

Non-Final Office Action dated Feb. 22, 2021 in U.S. Appl. No. 16/386,757, 9 pages.
Final Office Action dated Jun. 24, 2021, in U.S. Appl. No. 16/386,757, 10 pages.

* cited by examiner

INK-BASED MARKING DEVICE HAVING A MULTI-COMPONENT NIB STRUCTURE

CROSS-REFERENCE TO RELATED APPLICATIONS

This is a Divisional Application of U.S. patent application Ser. No. 16/386,757, titled "Ink-based Marking Device Having a Multi-component Nib Structure," filed on Apr. 17, 2019, which in turn claims priority to U.S. Provisional Application No. 62/658,699, titled "Ink-based Marking Device Having a Multi-component Nib structure," filed on Apr. 17, 2018, all of which are incorporated by reference in their entirety herein.

SUMMARY

Embodiments of the invention are defined by the claims below, not this summary. A high-level overview of various aspects of the invention disclosure introduces a selection of concepts that are further described below in the detailed description. This summary is not intended to identify key features or essential features of the claimed subject matter, nor is it intended to be used as an aid in isolation to determine the scope of the claimed subject matter.

In brief and at a high level, this disclosure describes, among other things, a system, method, and ink-based marking device. The ink-based marking device, in accordance with aspects herein, is configured to create markings with different shading (e.g., ombre style), or simultaneously create markings with both a primary lettering color and a secondary shading color. The ink-based marking device may comprise a multi-component nib structure. Each component of the multi-component nib structure may have a different density/porosity. Further, there may be different configurations for the multi-component nib structure.

DESCRIPTION OF THE DRAWINGS

Illustrative embodiments of the invention are described in detail below with reference to the attached drawing figures, wherein.

DETAILED DESCRIPTION

Figure 1A:
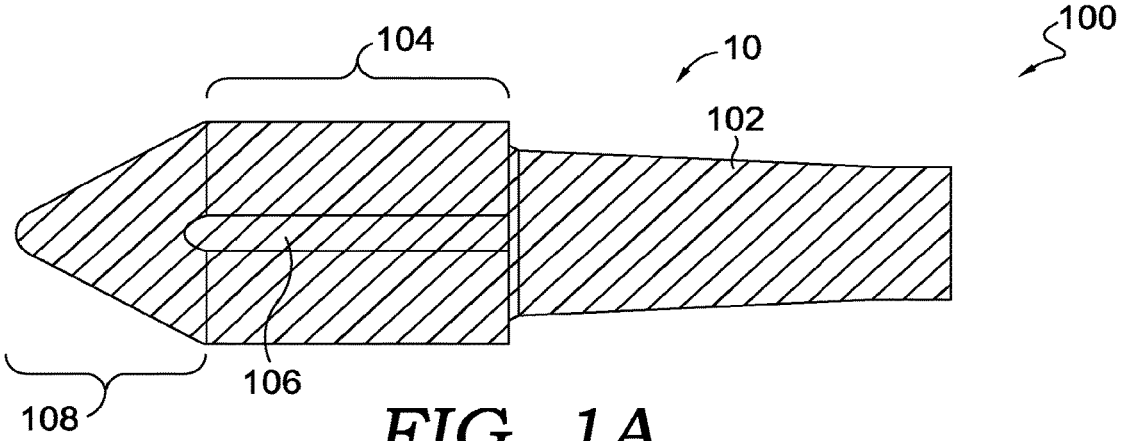
FIG. 1A is a perspective view of a first exemplary configuration of the multi-component nib structure in accordance with aspects of the invention.

The subject matter of embodiments of the invention is described with specificity herein to meet statutory requirements. But the description itself is not intended to necessarily limit the scope of claims. Rather, the claimed subject matter might be embodied in other ways to include different steps or combinations of steps similar to the ones described in this document, in conjunction with other present or future technologies. Terms should not be interpreted as implying any particular order among or between various steps herein disclosed unless and except when the order of individual steps is explicitly described.

In some aspects, the ink-based marking device may be configured to dispense gradient tones of markings from a common ink reservoir based on a first configuration for the multi-component nib structure. In other aspects, the ink-based marking device may be configured to make markings with a primary color and a secondary color, where the primary color may be used for lettering and the secondary color may be used for shading, or vice versa based on other configurations for the multi-component nib structure. Yet in other aspects, the ink-based marking device may be configured to make markings with at least a first color and a second color that may or may not be the in the same tonality.

In certain aspects, the multi-component nib structure may be configured as a unitary nib structure having different areas of different densities/porosities feeding from a single ink reservoir. In other aspects, the multi-component nib structure may be configured as multiple nibs having the same or different densities/porosities, being coupled together, and feeding from separate ink reservoirs. Further, the marking device in accordance with aspects herein, may include ink flow properties that may direct ink from one or more reservoirs to one or more separate portions of the multi-component nib structure. For example, one or more ink sources, such as an ink-filled marker barrel or ink-loaded marker reservoir, may provide ink to only one component of the multi-component nib structure, while the other component of the multi-component nib structure is fed ink from a first component of the multi-component nib structure. In other aspects, a common ink source may provide ink to both primary and secondary nib components, either at the same time or sequentially by virtue of ink flow between the components of the multi-component nib structure.

In further aspects, the different areas/components of the multi-component nib structure may be separated by a non-permeable boundary that obstructs ink flow between the different areas/components of the multi-component nib structure. In other aspects, the different areas/components of the multi-component nib structure may be separated by a partially permeable boundary that permits a threshold amount of ink to flow from one area/component to another area/component of the multi-component nib structure. Depending on the specific configuration of the multi-component nib structure, different marking characteristics (i.e., primary and secondary colorant and/or shading) may be derived from a common ink reservoir or separate ink reservoirs. As such, lettering with the marking device may include both a primary lettering color and a secondary shading color depending on which portion of which multi-component nib structure is in contact with the writing surface. In other aspects, instead of a membrane, the multi-component nib structure may comprise a nib dividing component. The nib dividing component may be comprised of a chemical and/or physical boundary extending along at least a portion of the length of the multi-component nib structure to prevent or facilitate ink exchange between a particular nib portion and a marker barrel and/or ink reservoir. The nib dividing component may be a semipermeable barrier and/or a selectively permeable barrier that permits flow of ink from, for example, a first nib component to a second nib component, with the second nib component having a different porosity than the first nib component, to provide a primary marking and secondary shading device within the marking device. Since the dividing component may create a space between, for example, a first component and a second component of the multi-component nib structure, any marking output from the first component may also be spaced apart from any marking output from the second component of the multi-component nib structure.

Figure 1B:
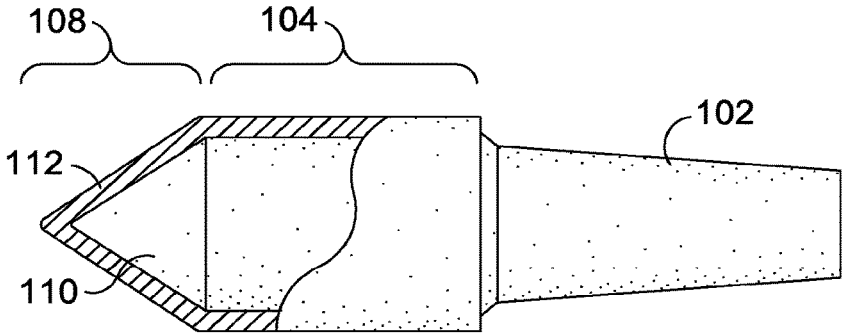
FIG. 1B is a cut-out view of the first exemplary multi-component nib structure in accordance with aspects of the invention.
Figure 1C:
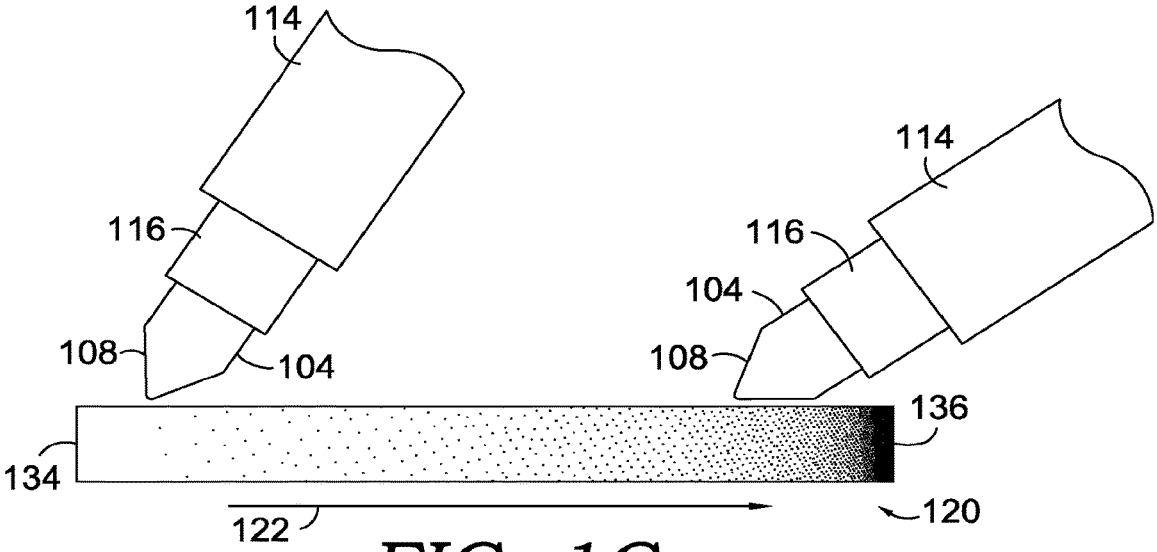
FIGS. 1C and 1D depict exemplary markings made with the first exemplary multi-component nib structure of FIGS. 1A and 1B in accordance with aspects of the invention.

Moving on to FIG. 1A, a perspective view 10 of a conical multi-component nib structure 100 is shown. The conical multi-component nib structure 100 comprises a shank portion 102, a conduction band 104, and a tip 108. The conical multi-component nib structure 100 may comprise an optional slit 106 that in some instances, may serve as a breather hole/tunnel, or as a fitting component that aids in the fitting of the conical multi-component nib structure 100 in a housing 114, which may comprise a lip 116 for coupling with the conduction band 104 of the multi-component nib structure 100, as shown in FIG. 1C. As shown in FIG. 1B, the conical multi-component nib structure 100 may be comprised of a first component 110 having a first density/porosity enveloped by a second component 112 having a second density/porosity. The density/porosity of the first component 110 may be different than the second component 112 of the conical multi-component nib structure 100. In particular, the density of the first component 110 is higher than the density of the second component 112, or in other words, the porosity of the second component 112 is higher than the porosity of the first component 110. Thus, when the shank portion 102 is coupled to an ink reservoir (not shown), as will become more apparent with respect to FIGS. 3-5, the first component 110 is able to absorb more ink (i.e., an amount larger than) from the ink reservoir than the second component 112.

In the multi-component nib structure 100, as described with respect to FIG. 1B, the first component 110 is enveloped or enclosed by the second component 112, with the porosity of the second component 112 being higher than the porosity of the first component. FIG. 1C depicts an effect of pressure on the multi-component nib structure 100 when using a marking device equipped with the multi-component nib structure 100 in accordance with aspects herein. As shown in FIG. 1B, a volume occupied by the first component 110 is greater than a volume occupied by the second component 112 at least at the tip 108 since the second component 112 is a layer of material wrapped around a core formed by the first component 110. As such, when only light or no pressure is applied to the marking device, only the ink available to the second component 112 will be transferred to a writing surface. However, as pressure on the marking device is gradually increased by the user (the user pushes down on the marking device), ink absorbed into the second component 112 is able to be released in addition to ink absorbed into the first component 110. Therefore, as shown in FIG. 1C, depending on a gradual increase in pressure applied to the marking device, the mark 120 made on the writing surface may gradually increase in the direction of the gradient 122 from a first side 134 toward a second side 136. As shown in FIG. 1C, on the first side 134 of the mark 120, light or no pressure is applied to the marking device so that there is minimal or low contact with the marking surface, thereby making a light mark on the first side 134. On the other hand, as also shown in FIG. 1C, when higher pressure is applied on the marking device, the contact with the writing surface is increased or maximized so that more ink is able to flow onto the writing surface and thus, a darker mark is made toward the second side 136.

Figure 1D:
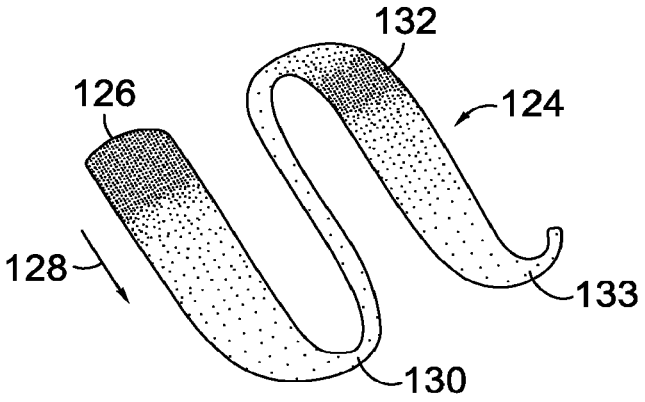

FIG. 1D shows a mark 124 having an ombre effect created with the multi-component nib structure 100. When making the mark 124, a user may start by applying a high amount of pressure at portion 126 and gradually decrease the amount of pressure as the tip 108 of the multi-component nib structure 100 is moved in the direction of the arrow 128, resulting in a gradually lighter mark as in portion 130, gradually increase the amount of pressure back up as moving toward portion 132, and gradually decrease the amount of pressure back down as the tip 108 of the multi-component nib structure 100 is moved, resulting in a gradually lighter mark as in portion 133 of mark 124.

Figure 2:
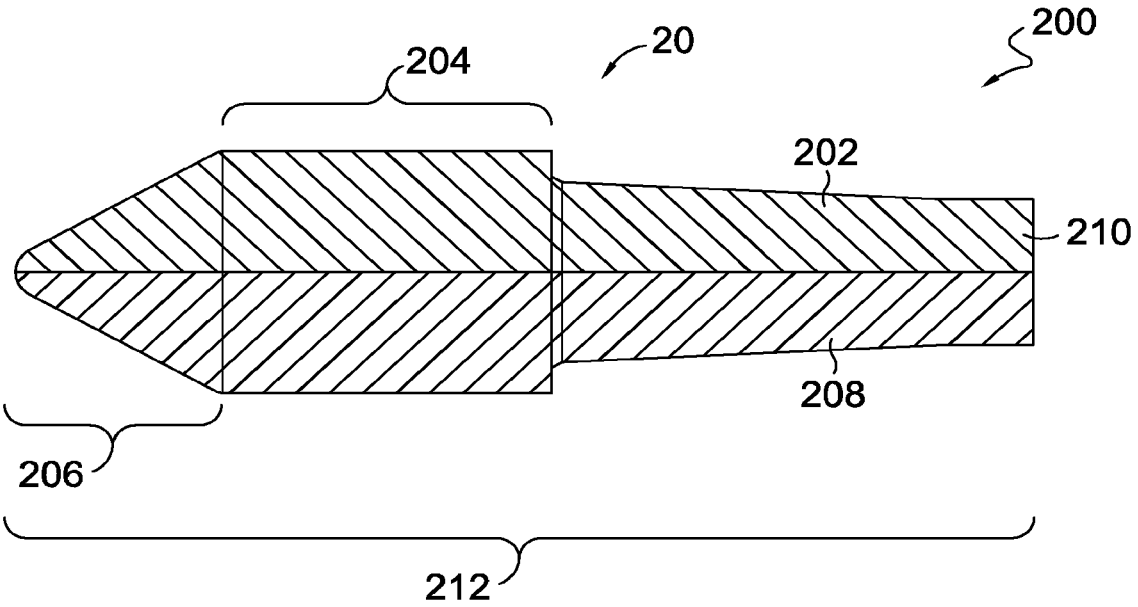
FIG. 2 is a perspective view of a second exemplary configuration of the multi-component nib structure in accordance with aspects of the invention.

In FIG. 2, a perspective view 20 of a different conical multi-component nib structure 200, is shown. The conical multi-component nib structure 200, like the conical multi-component nib structure 100 comprises a shank portion 202, a conduction band 204, and a tip 206. The conical multi-component nib structure 200 is divided along a length 212 into a first component 208 having a first density/porosity and a second component 210 having a second density/porosity, that are arranged in a side by side relationship. In this example, the conical multi-component nib structure 200 may provide, for example, different writing characteristics from the first component 208 and the second component 210, respectively. As shown in the perspective view 30 of FIG. 3 the conical multi-component nib structure 200 may be coupled to an ink reservoir 300 by having at least a portion 306 of the shank portion 202 inserted inside the ink reservoir 300. The ink reservoir 300 may be comprised of a first compartment 302 having a first ink color or shade and a second compartment 304 having a second ink color or shade (as shown), or the ink reservoir 300 may be comprised of one compartment having a single ink color (not shown). The conical multi-component nib structure 200 can be used to make multi-tonal markings based on the characteristics of the first component 208 and the second component 210, including a primary lettering color with ink dispensed from, for example, the first compartment 302 and a secondary shading color with ink dispensed from the second compartment 304. In one aspect, the primary lettering color and the secondary shading color may comprise a tonal difference, or in another aspect, the primary lettering color may be comprised of a first color and the secondary shading color may comprised of a second color that is different from the first color. In the case of a single compartment ink reservoir, the difference in shade may be achieved by a difference in ink volume being dispensed from the first component 208 or the second component 210 of the multi-component nib structure 200.

Figure 4A:
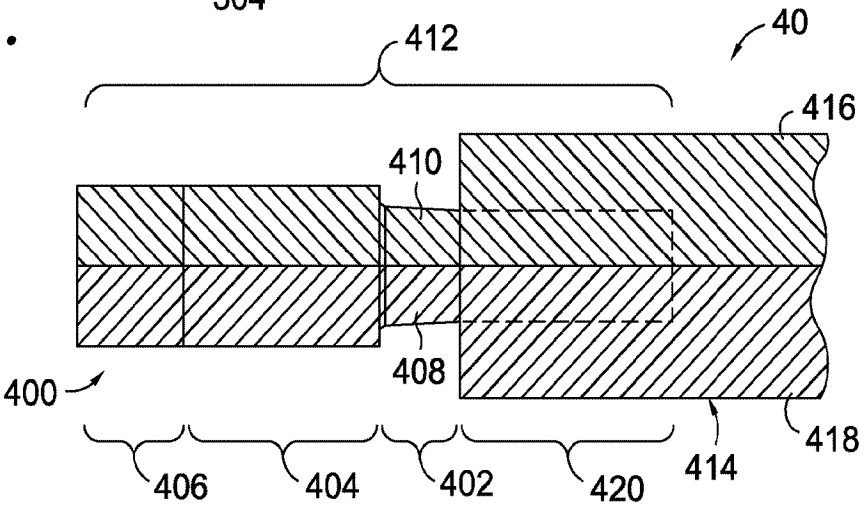
FIG. 4A is a first perspective view of a third exemplary configuration of the multi-component nib structure in accordance with aspects of the invention.

FIG. 4A depicts a perspective view 40 of a flat tip multi-component nib structure 400 is shown. The flat tip multi-component nib structure 400, like the conical multi-component nib structure 200 comprises a shank portion 402, a conduction band 404, and a tip 406. The flat tip multi-component nib structure 400 is divided along a length 412 into a first component 408 having a first density/porosity and a second component 410 having a second density/porosity, that are arranged in a side by side relationship and directly adjacent to each other. In this example, the flat tip multi-component nib structure 400 may also provide, for example, two different writing characteristics from the first component 408 and the second component 410, respectively. The flat tip multi-component nib structure 400 may be coupled to an ink reservoir 414 by having at least a portion 420 of the shank portion 402 inserted inside the ink reservoir 414. The ink reservoir 414 may be comprised of a first compartment 416 having a first ink color or shade and a second compartment 418 having a second ink color or shade (as shown), or the ink reservoir 414 may be comprised of one compartment having a single ink color (not shown). The flat tip multi-component nib structure 400, like the conical multi-component nib structure 200, can also be used to make multi-tonal markings including a primary lettering color dispensed from, for example, the first compartment 416 and a secondary shading color dispensed from the second compartment 418. In one aspect, the primary lettering color and the secondary shading color may comprise a tonal difference, or in another aspect, the primary lettering color may be comprised of a first color and the secondary shading color may comprised of a second color that is different from the first color.

Figure 4B:
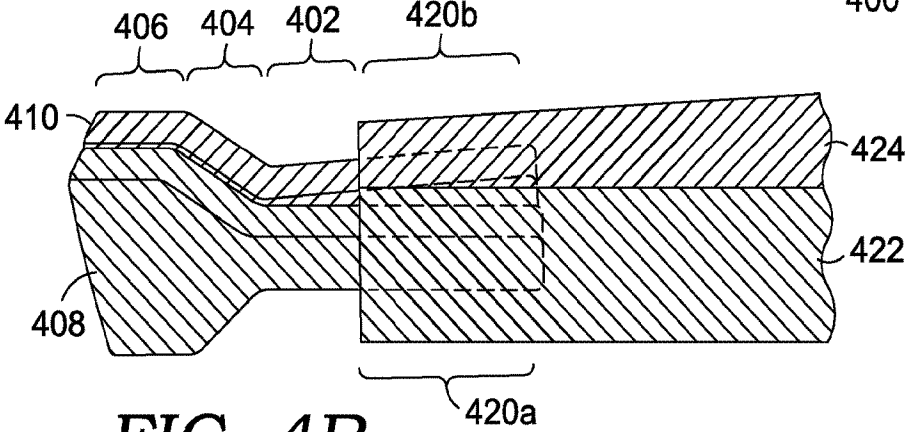
FIG. 4B is a second perspective view of the third exemplary configuration of the multi-component nib structure in accordance with aspects of the invention.

In accordance with other aspects, as shown in FIG. 4B, the first component 408 and the second component 410 of the flat tip multi-component nib structure 400 may be directly adjacent to each other at the tip 406 and gradually start separating through the conduction band 404 until they are completely separated in the shank portion 402 such that at least a portion 420*a* may be coupled to and inserted to a first ink reservoir 422 and at least a portion 420*b* may be coupled to and inserted to a separate second ink reservoir 424. It is to be understood that, although this configuration is only shown with respect to the flat tip multi-component nib structure 400, the conical multi-component nib structure 200, and the angled tip multi-component nib structure 500 may also have the configuration shown in FIG. 4B.

Figure 5:
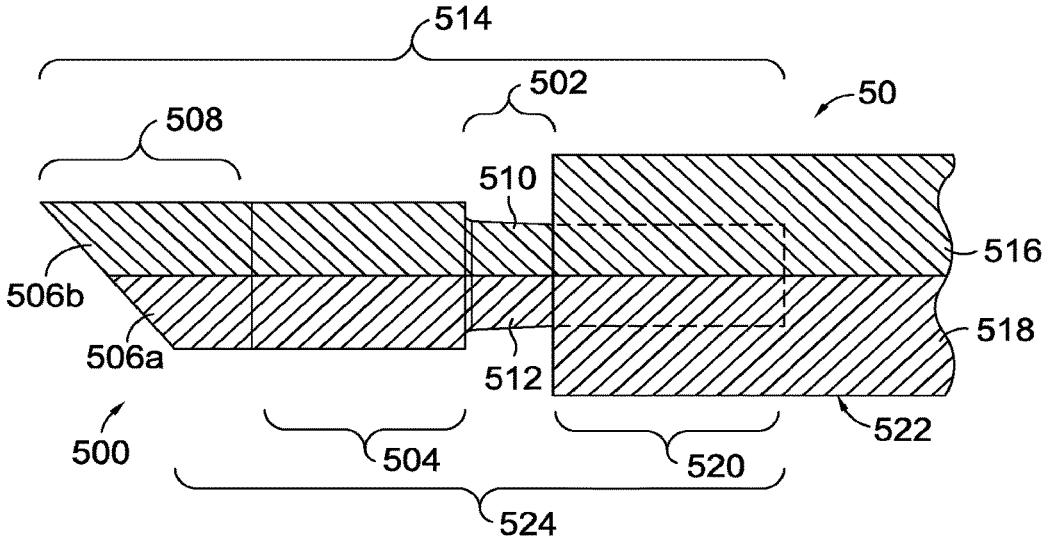
FIG. 5 is a perspective view of a fourth exemplary configuration of the multi-component nib structure in accordance with aspects of the invention.

FIG. 5 depicts a perspective view 50 of an angled tip multi-component nib structure 500 is shown. The angled tip multi-component nib structure 500, like the conical multi-component nib structure 200 and the flat tip multi-component nib structure 400 comprises a shank portion 502, a conduction band 504, and a tip 508. The angled tip multi-component nib structure 500 is divided along a length 514 into a first component 510 having a first density/porosity and a second component 512 having a second density/porosity, that are arranged in a side by side relationship and directly adjacent to each other. In this example, the angled tip multi-component nib structure 500 may also provide, for example, two different writing characteristics from the first component 510 and the second component 512, respectively. The angled tip multi-component nib structure 500 may be coupled to an ink reservoir 522 by having at least a portion 520 of the shank portion 502 inserted inside the ink reservoir 522. The ink reservoir 522 may be comprised of a first compartment 516 having a first ink color or shade and a second compartment 518 having a second ink color or shade (as shown), or the ink reservoir 522 may be comprised of one compartment having a single ink color (not shown). The angled tip multi-component nib structure 500, like the conical multi-component nib structure 200 and the flat tip multi-component nib structure 400, can also be used to make multi-tonal markings including a primary lettering color dispensed from, for example, the first compartment 516 and a secondary shading color dispensed from the second compartment 518. In one aspect, the primary lettering color and the secondary shading color may comprise a tonal difference, or in another aspect, the primary lettering color may be comprised of a first color and the secondary shading color may comprised of a second color that is different from the first color. In the angled tip multi-component nib structure 500, the tip portion 506*a* may be shorter than the tip portion 506*b* of the angled tip multi-component nib structure 500, such that a length 524 measured on a first side of the angled tip multi-component nib structure 500 is shorter than a length 514 measured on a second side of the angled tip multi-component nib structure 500.

Figure 3:
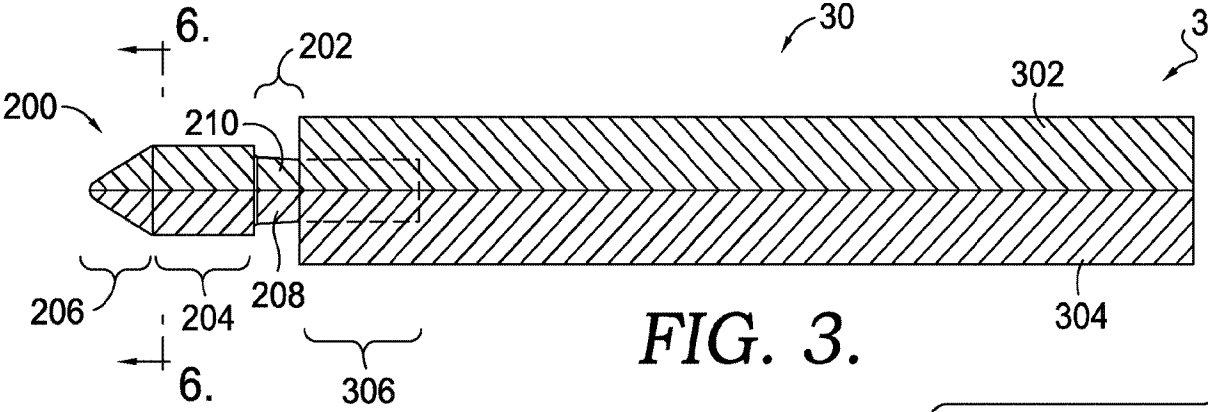
FIG. 3 is another perspective view of the second exemplary configuration of the multi-component nib structure in accordance with aspects of the invention.
Figure 6:
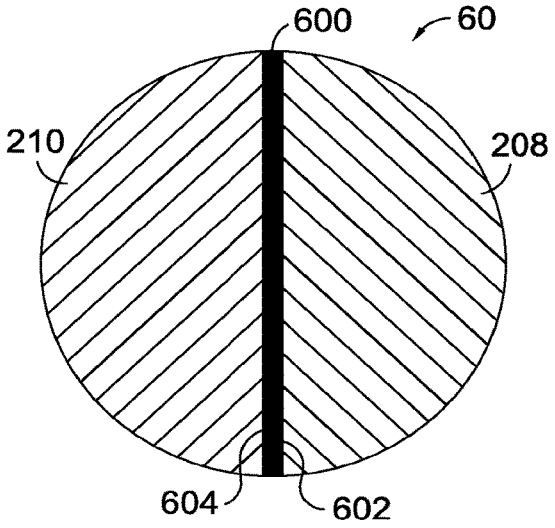
FIG. 6 is a cross-sectional view of the second multi-component nib structure of FIG. 3 along the line 6-6 in accordance with aspects of the invention.

Moving on to FIG. 6, a cross-sectional view 60 of the conical multi-component nib structure 200 in FIG. 3 is shown. As described above, a first component of 208 of the multi-component nib structure 200 may be comprised of a first material having a first density/porosity, and the second component 210 of the multi-component nib structure 200 may be comprised of a second material having a second density/porosity. Thus in certain aspects, a first amount of ink may be permitted to travel from the ink reservoir 300 through the first component 208 starting from the shank portion 202 towards the tip 206 at a first flow rate, and a second amount of ink may be permitted to travel from the ink reservoir 300 through the second component 210 starting from the shank portion 202 towards the tip 206 at a second flow rate. In other aspects, the multi-component nib structure 200 may comprise a physical barrier 600 comprised of an impermeable membrane/thin film, or a semipermeable membrane/thin film. As shown in FIG. 6, the physical barrier 600 may have a first surface 602 adjacent to the first component 208 and a second surface 604 adjacent to the second component 210.

Further, as briefly described above, the ink reservoir 300 may be comprised of a single ink compartment containing one color (not shown), or multiple ink compartments such as, for example, the first compartment 302 and the second compartment 304, as shown in FIG. 3, each of the first compartment 302 and the second compartment 304 having either different shades of an ink color, or different colors altogether. In either case, the physical barrier 600 when impermeable, may block ink from the first component 208 from flowing into the second component 210. On the other hand, when the physical barrier 600 is semipermeable, some ink may be allowed to flow from the first component 208 to the second component 210. As a result, a mark made with the multi-component nib structure 200 may include both the ink from the first compartment 302 and the ink from the second compartment 304. In the case where the physical barrier 600 is impermeable, the mark may have a clear division between the ink from the first compartment 302 and the ink from the second compartment 304. On the other hand, where the physical barrier 600 is semipermeable, the division between the ink from the first compartment 302 and the ink from the second compartment 304 may be fuzzy, or intermixed, such as in a tie dye. It is to be understood that the overall profile of the multi-compartment nib structure is inconsequential, or in other words, the overall profile may be rounded (as shown), slanted, ridged, pointed, angled, straight, offset at an angle, and the like.

Figure 7:
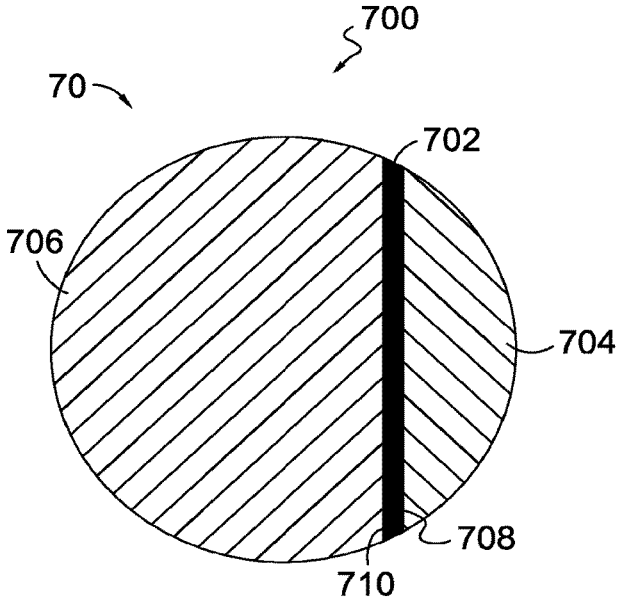
FIG. 7 is a cross-sectional view of a fifth exemplary multi-component nib structure in accordance with aspects of the invention.

Moving on to FIG. 7, a cross-sectional view 70 of a different configuration for the multi-component nib structure 700 having a first component 704 of a first material and a second component 706 of a second material, is shown. As shown, the multi-component nib structure 700, like the multi-component nib structure 200, may also have a physical barrier 702 located between a first component 704 and a second component 706, with a surface 708 of the physical barrier 702 facing the first component 704 and a surface 710 of the physical barrier 702 facing the second component 706. However, as shown in FIG. 7, the first component 704 or the second component 706 may have different volumes. For example, in the example shown in FIG. 7, the first component 704 may comprise a smaller volume than the second component 706, or vice versa, which can be observed by the difference in surface areas depicted in the cross-sectional view 70. In other words, the physical barrier 700 may be offset from a midline of the multi-component nib structure.

Figure 8A:
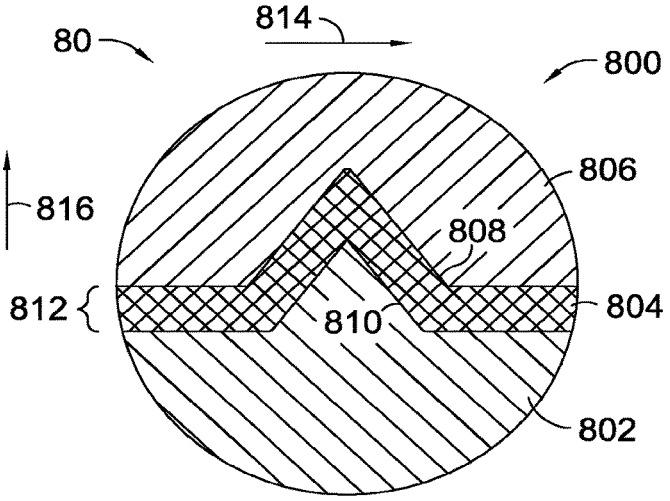
FIG. 8A is a cross-sectional view of a configuration of a sixth exemplary multi-component nib structure in accordance with aspects of the invention.
Figure 8B:
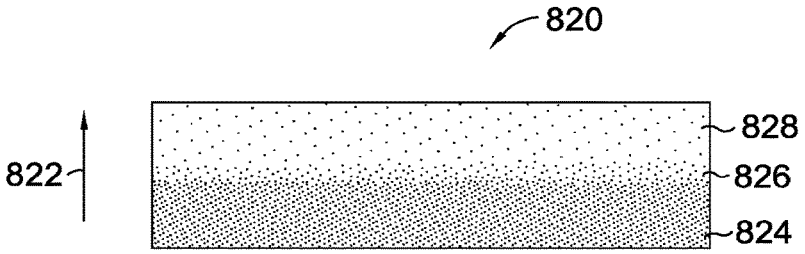
FIG. 8B is an exemplary marking made with the sixth exemplary multi-component nib structure of FIG. 8A in accordance with aspects of the invention.

In further aspects, as shown in the cross-sectional view 80 of a multi-component nib structure 800 in FIG. 8A, the multi-component nib structure 800 may comprise a first component 802, a second component 804, and a third component 806, where the second component 804 may be at an offset position within the third component 806. As shown, rather than the physical barrier being a membrane or thin film as shown in FIGS. 6 and 7, for example, the second component 804 may have a thickness 812, and may be configured in a zig-zag configuration (as shown) or may be configured in a straight line, a curved line, or any other suitable configuration, depending on a ratio of first component 802 and third component 806 desired. In accordance with aspects herein, the first component 802 may have a first density/porosity and the third component 806 may have a third density/porosity, and the second component 804 may have an intermediate density/porosity that is between the first density/porosity and the third density/porosity. The second component 804 may serve as an overlap portion, thus when creating a marking 820 (shown in FIG. 8B) in the direction 814 that is orthogonal to a stacking direction 816 of the first component 802, the second component 804, and the third component 806, the marking may have an ombre effect with a gradient 822 with the darkest portion 824 being formed by the first component 802 having the lowest density/highest porosity, followed by an intermediate portion 826 formed by the second component 804 having the intermediate density/porosity, and the lightest portion 828 formed by the third component 806 having the highest density/lowest porosity.

Figure 9A:
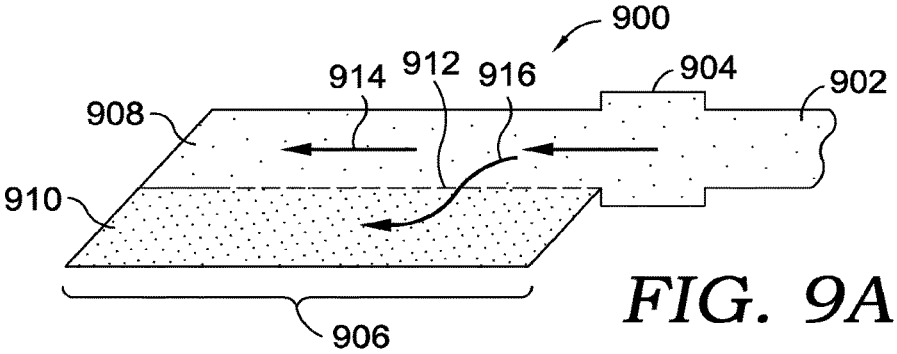
FIG. 9A is a perspective view of a configuration of a seventh exemplary multi-component nib structure in accordance with aspects of the invention.
Figure 9B:
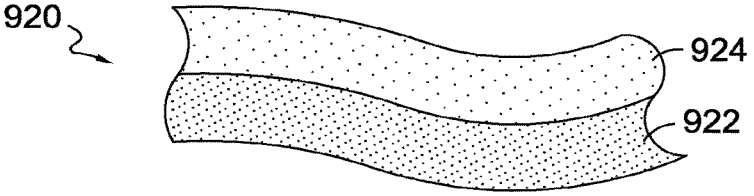
FIG. 9B is an exemplary marking made with the seventh exemplary multi-component nib structure in FIG. 9A in accordance with aspects of the invention.

FIG. 9A depicts yet another exemplary multi-component nib structure 900 comprising a shank 902, a conduction band 904, and a tip portion 906. As shown, the shank 902 may be continuous with only a first component 908 extending from the shank 902, through the conduction band 904, and through the tip portion 906. The tip portion 906, however, may be comprised of the first component 908 and a second component 910. As discussed above with reference to FIGS. 6, 7, and 8, the multi-component nib structure 900 may also comprise a physical barrier 912 comprised of a semipermeable or permeable membrane/thin film. In accordance with aspects herein, the first component 908 may be comprised of a lower density material so that as the ink contained within an ink reservoir coupled to the shank 902 flows in the direction of the arrow 914 toward the tip portion 906, some ink is allowed to flow in the direction of the arrow 916 into the second component 910 comprised of a higher density material. As such, as shown in FIG. 9B, a marking 920 formed with the multi-component nib structure 900 may comprise a darker portion 922 and a lighter portion 924. Although the multi-component nib-structure 900 is depicted as having an angled tip, it is contemplated that the tip portion 906 may have any other profiles, such as, for example, rounded, slanted, ridged, pointed, straight, offset at an angle, and the like.

Figure 10A:
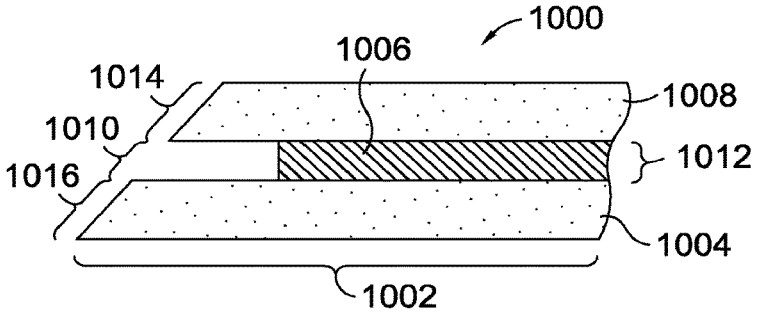
FIG. 10A is a perspective view of a configuration of an eighth exemplary multi-component nib structure in accordance with aspects of the invention.
Figure 10B:
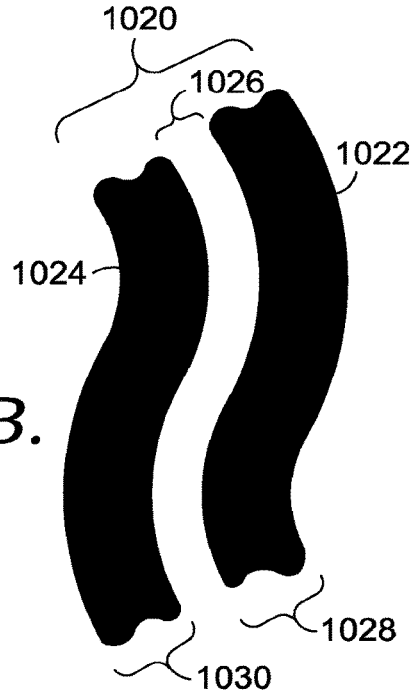
FIG. 10B is an exemplary marking made with the eighth exemplary multi-component nib structure in FIG. 10A in accordance with aspects of the invention.

FIG. 10A depicts yet another exemplary multi-component nib structure 1000. In the multi-component nib structure 1000, the tip 1002 may have the first component 1008 spaced apart from the second component 1004 by spacer 1006 by a distance 1010. It is contemplated that the spacer 1006 may be impermeable (i.e., non-porous) or permeable (i.e., porous) according to the desired effects for the multi-component nib structure 1000. For example, if complete color or shade separation is desired, the spacer 1006 may be made to be impermeable from a solid plastic, rubber, or thermoplastic material, for example. On the other hand, if some color or shade mixing is desired, the spacer 1006 may be made permeable from a foam or fiber material that is able to serve as an ink transfer portion that facilitates a threshold quantity of ink to transfer from the first component 1008 to the second component 1004 and vice versa according to the particular density/porosity characteristics of the respective first component 1008 or the second component 1004. Therefore, each of the first component 1008 and the second component 1004 may comprise respective shank portions (not shown) coupled to their respective ink reservoirs or respective compartments of a single ink reservoir, as shown in FIGS. 3-5, or a single compartment ink reservoir (not shown). As well, if configured like the tip in FIG. 9A, only one of the first component 1008 or the second component 1004 may comprise a shank portion connected to an ink reservoir, and transfer ink to the other of the first component 1008 or the second component 1004 through the spacer 1006. The spacer 1006 may comprise a width 1012 that determines the distance 1010 by which the first component 1008 and the second component 1004 are separated. This distance may be varied depending on the marking effect desired for the multi-component nib structure 1000. For example, when both the first component 1008 and second component 1004 are simultaneously contacted with a writing surface, a marking 1020 may be formed having a first mark 1022 having a width 1028 and a second mark 1024 having a width 1030 spaced apart by a distance 1026, as shown in FIG. 10B. The distance 1026 may substantially correspond to the distance 1010 by which the first component 1008 and the second component 1004 of the multi-component nib structure 1000 are separated, and the widths 1028 and 1030 of the first and second marks 1022 and 1024, respectively, may substantially correspond to the width 1014 and 1016 of the first and second components 1008 and 1004, respectively. By substantially in accordance with aspects herein, it is meant that the respective measurements of the respective compared widths and distances are at least 90±0.5% analogous, at least 92±0.5% analogous, 94±0.5% analogous, 96±0.5% analogous, or 98±0.5% analogous. Although the multi-component nib-structure 1000 is depicted as having an angled tip, it is contemplated that the tip of the multi-component nib structure 1000 may have any other profiles, such as, for example, rounded, slanted, ridged, pointed, straight, offset at an angle, and the like.

Figure 11A:
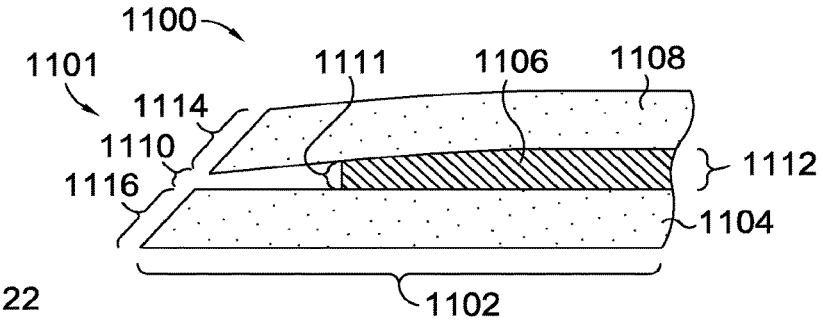
FIG. 11A is a perspective view of a configuration of a ninth exemplary multi-component nib structure in accordance with aspects of the invention.
Figure 11B:
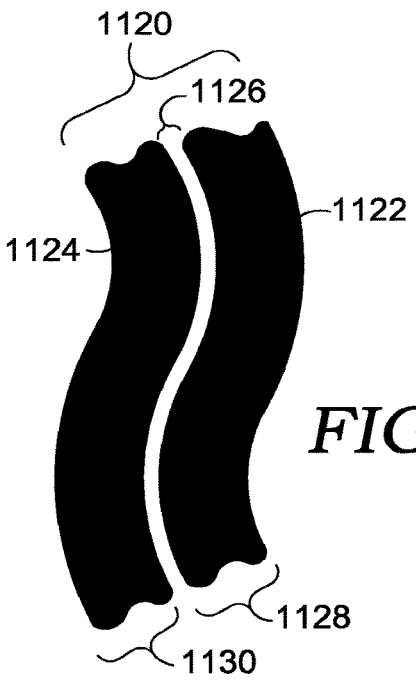
FIG. 11B is an exemplary marking made with the ninth exemplary multi-component nib structure in FIG. 11A in accordance with aspects of the invention.

FIG. 11A depicts a multi-component nib structure 1100. In the multi-component nib structure 1100, the tip 1102 may have the first component 1108 spaced apart from the second component 1104 by spacer 1106. Unlike the multi-component nib structure 1000, however, the spacer 1106 may be configured to taper (i.e., become thinner) towards an end 1101 of the tip 1102 so that the distance 1110 between the first component 1108 and the second component 1104 becomes gradually smaller, thereby creating a more seamless end 1101 of the tip 1102 for contacting a writing surface. Like in the case for the multi-component nib structure 1000, it is contemplated that the spacer 1106 may be impermeable (i.e., non-porous) or permeable (i.e., porous) according to the desired effects for the multi-component nib structure 1100. For example, if complete color or shade separation is desired, the spacer 1106 may be made to be impermeable from a solid plastic, rubber, or thermoplastic material, for example. On the other hand, if some color or shade mixing is desired, the spacer 1106 may be made permeable from a foam or fiber material that is able to serve as an ink transfer portion that facilitates a threshold quantity of ink to transfer from the first component 1108 to the second component 1104 and vice versa according to the particular density/porosity characteristics of the respective first component 1108 or the second component 1104. Therefore, each of the first component 1108 and the second component 1104 may comprise respective shank portions (not shown) coupled to their respective ink reservoirs or respective compartments of a single ink reservoir, as shown in FIGS. 3-5, or a single compartment ink reservoir (not shown). As well, if configured like the tip in FIG. 9A, only one of the first component 1108 or the second component 1104 may comprise a shank portion connected to an ink reservoir, and transfer ink to the other of the first component 1008 or the second component 1104 through the spacer 1106. The spacer 1106 may comprise a width 1112 that as mentioned above, gradually tapers so that a final width 1111 determines the distance 1110 by which the first component 1108 and the second component 1104 are separated by at the end 1101 of the tip 1102. Of course, this distance may be varied depending on the marking effect desired for the multi-component nib structure 1100. For example, when both the first component 1108 and second component 1104 are simultaneously contacted with a writing surface, a marking 1120 may be formed having a first mark 1122 having a width 1128 and a second mark 1124 having a width 1130 spaced apart by a distance 1126, as shown in FIG. 11B. The distance 1126 may substantially correspond to the distance 1110 by which the first component 1108 and the second component 1104 of the multi-component nib structure 1100 are separated at the end 1101 of the tip 1102, and the widths 1128 and 1130 of the first and second marks 1122 and 1124, respectively, may substantially correspond to the width 1114 and 1116 of the first and second components 1108 and 1104, respectively. Although the multi-component nib-structure 1100 is depicted as having an angled tip, it is contemplated that the tip of the multi-component nib structure 1100 may have any other profiles, such as, for example, rounded, slanted, ridged, pointed, straight, offset at an angle, and the like.

Figure 12:
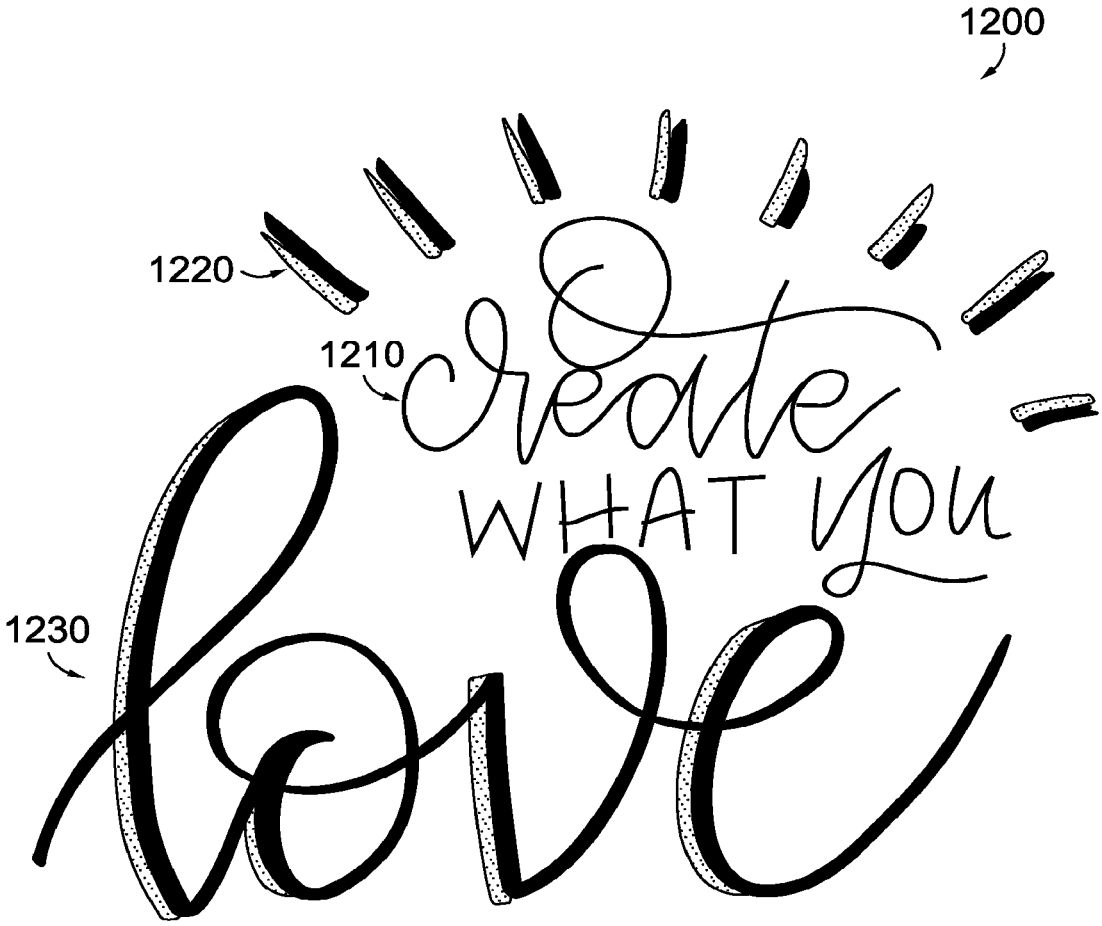
FIG. 12 is an exemplary marking made with a multi-component nib structure of, for example, FIG. 2-6, 9, 10, or 11 in accordance with aspects of the invention.

Although not shown, the components of the marking device include may include a housing and an optional cap for retaining at least the multi-component nib structure and the ink reservoir in a coupled configuration. For any of the multi-component nib structures discussed herein, it is contemplated that these may be held at different angles by a user of a marking device having any of the multi-component nib structures. The different angles of contact of the tip portion of the multi-component nib structures in accordance with aspects herein may create different effects on the ink markings released by the multi-component nib structures. For example, FIG. 12 depicts an exemplary artistic marking/lettering creation 1200 created by using a marking device having a multi-component nib structure in accordance with aspects herein. In the creation 1200, the phrase 1210 "create WHAT YOU" may be generated with a marking device by holding/gripping the marking device at a first angle or first position where only the tip of one component of the multi-component nib structure is contacted with the writing surface. The user may manipulate or shift the orientation of the tip of the multi-component nib structure by rotating or changing his/her grip on the housing of the marking device. As such, when the writing device is gripped so that both the first component and the second component of the tip of the multi-component nib structure are in contact with the writing surface, the resulting markings may have a shaded effect with adjacent light and dark marks. For example, the line marks 1220 may be created by using downward strokes with a multi-component nib structure having an angled tip as shown, for example, in FIGS. 5, 9A, 10A, 11A, which cause both the first component and the second component to contact the writing surface simultaneously. On the other hand, the word 1230 "love" may be formed by using upward strokes forcing the contact of only one of the first component or the second component having the primary shade or color ink, contact the writing surface to make the non-shaded marks, and continue on by using a downward stroke(s) to make the shaded marks by forcing simultaneous contact with the writing surface of both the first component and the second component of the multi-component nib structure in accordance with aspects herein.

The aspects described throughout this specification are intended in all respects to be illustrative rather than restrictive. Upon reading the present disclosure, alternative aspects will become apparent to ordinary skilled artisans that practice in areas relevant to the described aspects without departing from the scope of this disclosure. In addition, aspects of this technology are adapted to achieve certain features and possible advantages set forth throughout this disclosure, together with other advantages which are inherent. It will be understood that certain features and subcombinations are of utility and may be employed without reference to other features and subcombinations. This is contemplated by and is within the scope of the claims.

Since many different applications are available for the invention without departing from the scope thereof, it is to be understood that all matter herein set forth or shown in the accompanying drawings is to be interpreted as illustrative and not in a limiting sense.

The invention claimed is:

1. A multi-component nib structure for a marking device for selectively generating marks on a receiving surface comprising:

a tip portion;

a shank portion;

a first component; and a second component, wherein the first component is enveloped by the second component, and a first volume occupied by the first component is greater than a second volume occupied by the second component.

2. The multi-component nib structure of claim 1, wherein a second porosity of the second component is greater than a first porosity of the first component.

3. The multi-component nib structure of claim 1, wherein a first density of the first component is higher than a second density of the second component.

4. The multi-component nib structure of claim 1, wherein an ink flowing from the ink reservoir comes into contact and is absorbed by the second component before the ink flowing from the ink reservoir comes into contact and is absorbed by the first component.

5. The multi-component nib structure of claim 4, wherein a first pressure exerted on the marking device causes the multi-component nib structure to release a first amount of the ink, and wherein a second pressure exerted on the marking device causes the multi-component nib structure to release a second amount of the ink.

6. The multi-component nib structure of claim 5, wherein the second pressure is greater than the first pressure, and wherein the second amount of the ink is greater than the first amount of the ink.

7. The multi-component nib structure of claim 6, wherein the first pressure causes an output of a first shade of the ink that is lighter than an output of a second shade of the ink caused by the second pressure.

8. The multi-component nib structure of claim 7, wherein the first shade of the ink and the second shade of the ink create an ombre effect for the marks.

9. A marking device for selectively generating marks on a receiving surface, wherein the marking device comprises:

a housing having a lip portion;

an ink reservoir; and a multi-component nib structure having a tip portion, a shank portion, a first component, and a second component, wherein the shank portion of the multi-component nib structure couples to the ink reservoir and the lip portion of the housing, wherein the ink reservoir and the shank portion of the multi-component nib structure are housed within the housing, wherein the first component of the multi-component nib structure is enveloped by the second component of the multi-component nib structure, and wherein a first volume occupied by the first component of the multi-component nib structure is greater than a second volume occupied by the second component of the multi-component nib structure.

10. The marking device of claim 9, wherein the second component of the multi-component nib structure comprises a second porosity that is greater than a first porosity of the first component of the multi-component nib structure.

11. The marking device of claim 9, wherein a first density of the first component of the multi-component nib structure is higher than a second density of the second component of the multi-component nib structure.

12. The marking device of claim 9, wherein an ink flowing from the ink reservoir comes into contact and is absorbed by the second component of the multi-component nib structure before the ink flowing from the ink reservoir comes into contact and is absorbed by the first component of the multi-component nib structure.

13. The marking device of claim 12, wherein a first pressure exerted on the marking device causes the multi-component nib structure to release a first amount of the ink, and wherein a second pressure exerted on the marking device causes the multi-component nib structure to release a second amount of the ink.

14. The marking device of claim 13, wherein the second pressure is greater than the first pressure, and wherein the second amount of the ink is greater than the first amount of the ink.

15. The marking device of claim 14, wherein the first pressure causes an output of a first shade of the ink that is lighter than an output of a second shade of the ink caused by the second pressure.

16. The marking device of claim 15, wherein the first shade of the ink and the second shade of the ink create an ombre effect for the marks.

* * * * *